United States Patent [19]

Van Meter

[11] Patent Number: 4,976,321

[45] Date of Patent: Dec. 11, 1990

[54] HORIZONTAL EARTH BORING MACHINE AND METHOD

[75] Inventor: Brad Van Meter, Greenville, S.C.

[73] Assignee: McLaughlin Manufacturing Company, Inc., Greenville, S.C.

[21] Appl. No.: 331,656

[22] Filed: Mar. 29, 1989

[51] Int. Cl.[5] ..... E21B 3/02; E21B 44/00

[52] U.S. Cl. ..... 175/24; 175/26; 175/27; 175/62; 175/113; 173/170

[58] Field of Search ..... 175/24, 26, 27, 62 X, 175/113, 162; 173/4, 5, 146, 161 X, 170 X; 192/99 R

[56] References Cited

U.S. PATENT DOCUMENTS

| | | | |
|---|---|---|---|
| 1,834,727 | 12/1931 | Pearson | 173/170 |
| 1,868,685 | 7/1932 | Bayles | 173/161 |
| 1,940,693 | 12/1933 | Pearson | 173/170 |
| 2,617,629 | 11/1952 | Robinson | 173/170 |
| 2,696,972 | 12/1954 | Howe | 173/170 |
| 3,170,738 | 10/1963 | Osborn | 175/62 |
| 3,807,509 | 4/1974 | Linsay | 175/62 |
| 3,828,861 | 8/1974 | Verkuil | 173/170 |
| 3,907,043 | 9/1975 | Appleman | 175/62 |
| 4,024,923 | 5/1977 | Broodbent | 173/170 |
| 4,553,612 | 11/1985 | Durham | 175/203 |

*Primary Examiner*—Bruce M. Kisliuk
*Attorney, Agent, or Firm*—Bailey & Hardaway

[57] ABSTRACT

An earth boring apparatus is illustrated including an engine and an earth boring string wherein a hydraulic clutch driven by the engine is supplied with hydraulic fluid through an electrically operated valve controlled by a manually operated trigger so that release of the trigger resulting from a torque as may be occasioned by encountering a rock or other obstruction interrupts manual operation of the trigger disabling the clutch.

8 Claims, 2 Drawing Sheets

HORIZONTAL EARTH BORING MACHINE AND METHOD

BACKGROUND OF THE INVENTION

Horizontal earth boring drills utilizing manually operated transmissions connected to dual planetary final drives conventionally utilize automotive style clutch assemblies to enable the engagement and disengagement of the auger drive. This technology was borrowed from the automotive industry and is prevalent in many forms of construction equipment.

Such a system may consist of a driven steel clutch disk, lined with a suitable wear material, held against the flywheel of an internal combustion engine with a spring pressured plate. The driven disk is held firmly to the flywheel, until the spring exerted pressure is released. In the same way, an automobile is in gear, and remains so, until the clutch pedal is depressed, releasing the driven disk from the engine's flywheel.

This system has proven to be operable as a means for drive engagement and disengagement for gear driven horizontal boring machines. There exists a distinct disadvantage with the system, however, in the way that it relates to the operation of an earth drill.

A horizontal boring machine utilizes augers for excavation and removal of earth during the drilling process. The machine, through its drive train develops the necessary horsepower and torque requirements which will enable the drill string to penetrate, excavate and remove the earth for disposal. However, if the drill string encounters an obstruction that cannot be excavated, the energy that the machine developed to enable the excavation is transmitted back to the machine itself. The torque generated is unleashed at the machine, in that the machine physically tries to upset in a direction opposite to that of the applied torque. A comparison may be made to a hand drill that is being used to drill through a steel plate. If, for some reason, the drill bit hangs, the drill will experience the unloading of the torque energy, spinning away from the direction of the rotating drill bit. Since the clutch is manually operated, the machine operator must manually operate the clutch to avoid damage or injury. However, reaction time is often simply not sufficiently rapid to effect such manual actuation of the clutch in time to prevent injury or damage.

The prior art includes U.S. Pat. Nos. 1,857,897 and 3,037,576 which disclose control means associated with steering wheels. U.S. Pat. No. 4,230,200 illustrates a clutch which is disengaged upon release of a handle in a mower. U.S. Pat. No. 4,255,879 shows an auger with a dead man control.

Efforts to stop the engine of earth boring machines upon the development of torque as a result of the boring apparatus encountering an obstacle have produced unsatisfactory results because the engine has momentum built up which will not be released fast enough to avoid injury or damage.

Accordingly, it is an important object of this invention to provide apparatus for disconnecting the drive from the engine to the transmission gears as a result of the appearance of excessive torque in the hands of the operator so as to decrease or avoid the reaction time required to disconnect the drive.

SUMMARY OF THE INVENTION

The subject apparatus may include a hydraulic clutch which is normally off but which is supplied with hydraulic fluid to render same operable only when a trigger mechanism is manually actuated to operate a solenoid operated control valve to supply the hydraulic fluid to the hydraulic clutch. Thus, the hydraulic clutch can deliver power from the engine to the transmission gear only so long as the trigger mechanism is manually actuated.

The purpose of the trigger is to supply a fail safe device should the boring tool encounter an obstruction such as a boulder which would transmit torque through the power train to the earth boring apparatus. On present earth boring apparatus, the operator must disengage a clutch should such a torque appear as would turn over the machine or cause damage or injury. With the present device the operator need only step back or have the trigger dislodged from his hand. With the former devices the engine will continue to run until the clutch is manually disengaged.

It has been found that it is not desirable to have an earth boring machine in a continually on mode until the time is determined for it to be disengaged. In some cases, the machine operator's reaction time to determine and to take action to avoid machine upset, is not sufficient, when utilizing the conventional clutch system.

It has been found that a hydraulically activated clutch may be provided to replace the manual automotive system. A hydraulic clutch uses fluid within a cylinder to sandwich steel disks and fiber plates together to join a drive train. This action takes place in less than a second. Conversely, when the hydraulic system is depressurized, the plates and disks separate in the same time period. The clutch is pressurized to enable the rotation of the machine's drill string. The machine operator does this by activating an electric solenoid operated hydraulic valve that sends fluid under pressure to the clutch. The operator continues to hold the control that activates the drive, continuously during the drilling operation. If it becomes necessary to disengage the drive, releasing the control will deactivate the machine. The hydraulic clutch works in an opposite way to that of the manually released driven disk, in that it is continuously off until required and then activated. By contrast, the manual system is continually on in its operation, until released.

When used on a horizontal earth drill the hydraulic clutch becomes a device offering passive safety, in that the person operating the machine merely has to release the control to disarm the machines auger drive. Drive disengagement is positive and immediate. Manual systems require the time necessary for the operator to determine that his action is required to disengage the clutch and the actual time that it takes to manually complete this operation.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an earth boring apparatus having an engine A and boring apparatus including a drill string B. A hydraulic clutch C is operated by hydraulic fluid for providing a connection between the engine and the drill string. An electrically operated valve D is provided for supplying hydraulic fluid to the clutch. A manually operated trigger E opens the valve supplying hydraulic fluid to the clutch so long as the trigger is manually actuated and the engine is running. Thus, when a torque as may result from encountering an obstacle such as a rock is transmitted from the tool to the machine interrupting manual operation of the trigger operation of the clutch is automatically discontinued.

Figure 1:
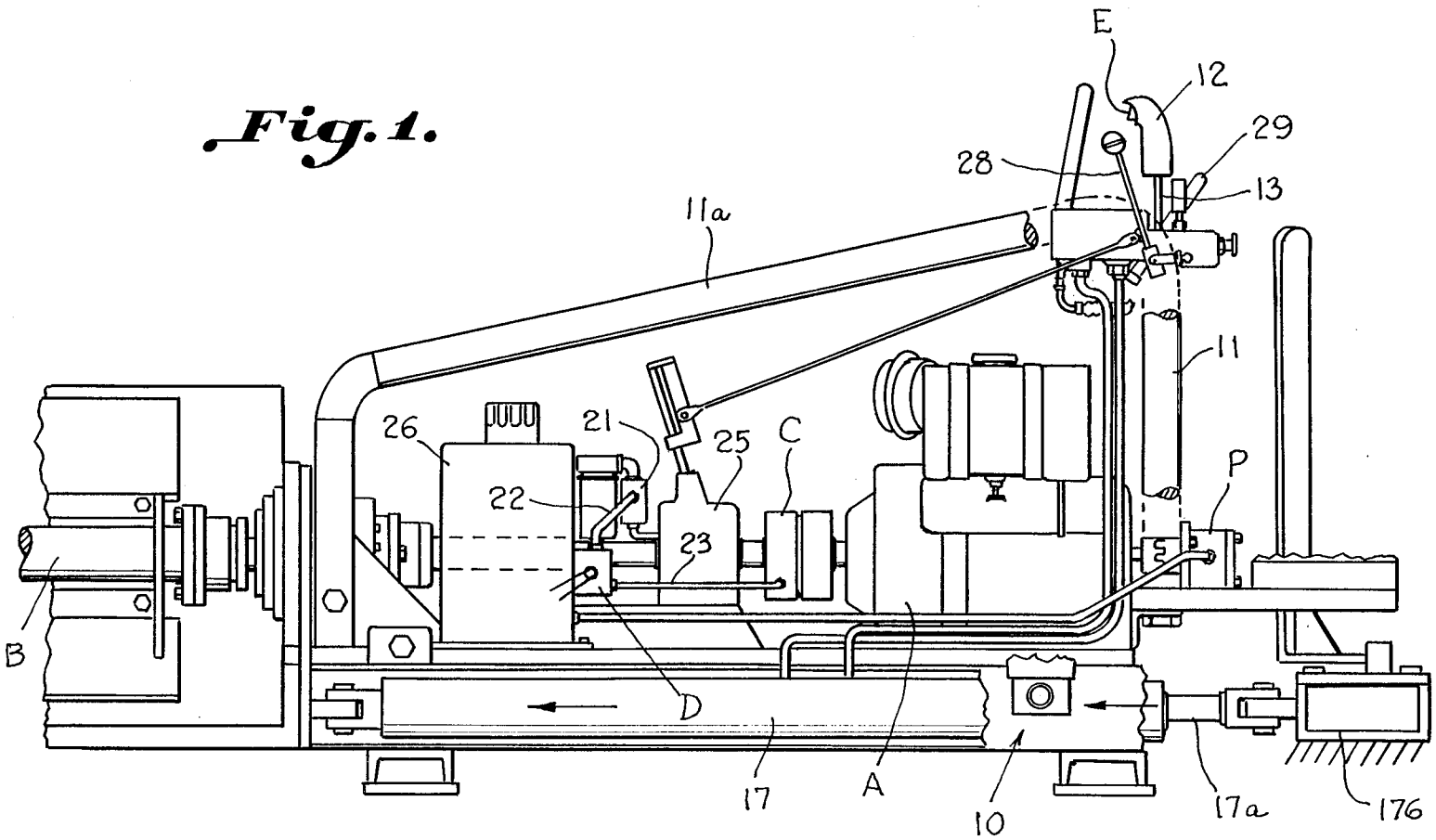
FIG. 1 is a side elevation illustrating an earth boring machine controlled in accordance with apparatus constructed according to the present invention wherein a control for automatically disabling operation of the machine upon encountering an obstacle which transmits torque such as to disengage the machine from the hands of the operator.
Figure 2:
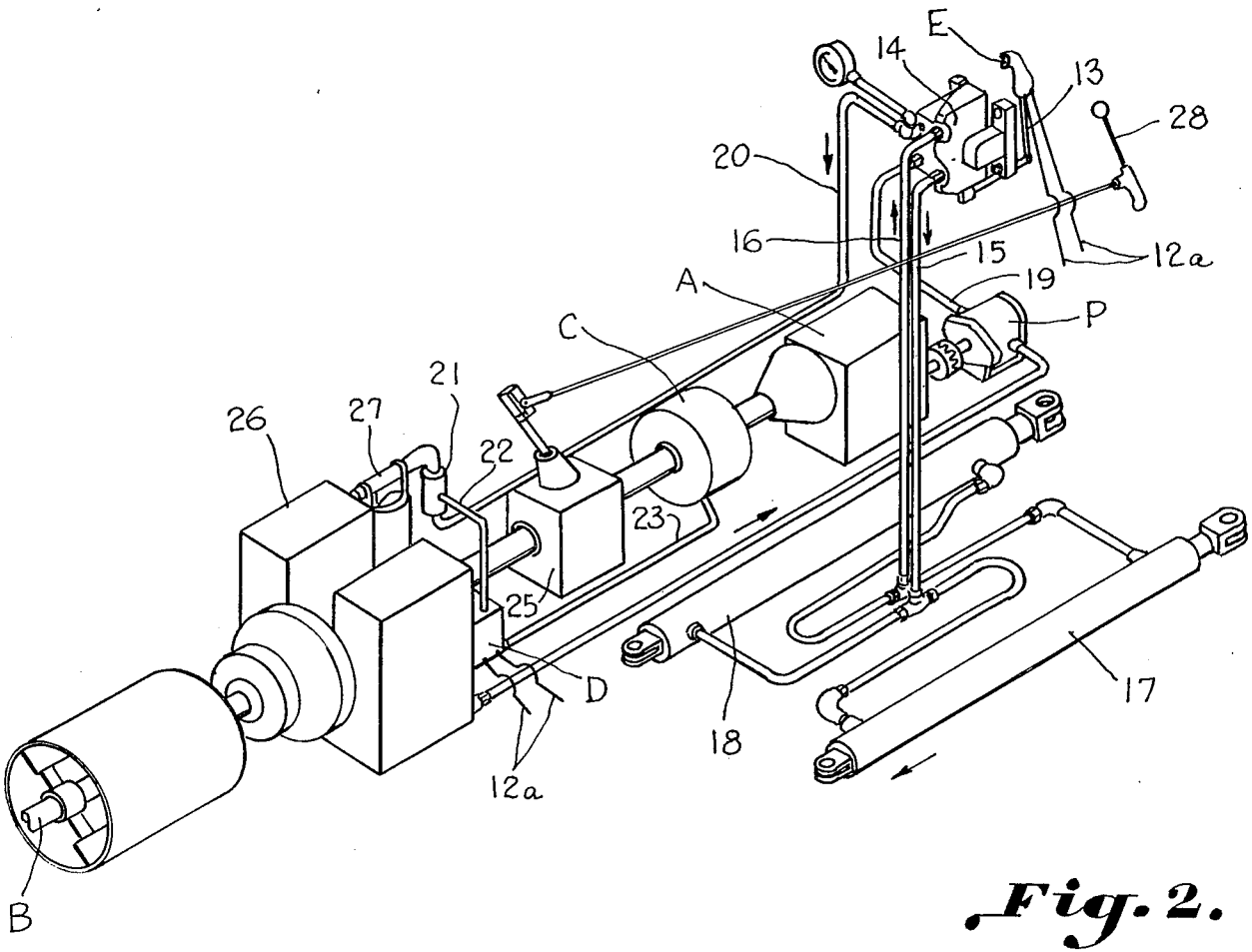
FIG. 2 is a perspective view schematically illustrating various hydraulic controls for the machine.

The apparatus described above including the hydraulic clutch C is carried by a frame which may include a horizontal support broadly designated at 10. The frame carries a vertical standard 11 adjacent one end for positioning controls including the trigger E. The vertical standard 11 has side bars 11*a* which act as guard members for the assembly. The manually depressible and automatically returnable trigger is illustrated as being carried by a handle grip 12. The trigger E may be provided with a guard (not shown) for preventing inadvertent contact. The handle 12 is mounted upon a control rod 13 for actuating the hydraulic control valve 14 which causes fluid to flow in the direction of the arrows through the lines 15 and 16 in FIG. 2 to operate the cylinders 17 and 18 advancing the machine and the drill string carried thereby during drilling. The cylinder rods 17*a* are connected to the fixed support 17*b* on one end and the cylinders to the frame 10 on an opposite end.

Fluid is provided by the pump P through the line 19 to the valve 14 and thence through line 20 to the check valve 21. The motor A drives the pump P. The check valve through the line 22 furnishes fluid to the solenoid operated control valve D. Fluid is transmitted from the control valve D to the hydraulic clutch C through the line 23.

The transmission gears 25 are controlled by the clutch for operating the earth boring string B. The tank 26 carries hydraulic fluid and is connected to the check valve 21 by the line 27. The gears of the transmission 25 are controlled by the lever 28. The operation of the motor is controlled by the lever 29.

It is thus seen that a fail safe operating device is provided for use with an earth boring machine drive and is disabled as a result of a torque as would disengage the machine from the control of the operator.

Apparatus in accordance with the present invention automatically disables the drive for the boring apparatus in the event that a torque is developed as a result of encountering an obstacle during boring. It is important that such automatic action takes place in that an operator's reaction time in manually actuating a clutching apparatus is often too long to avoid injury or damage. Disabling the motor had also proved to be impractical due to momentum in the engine which caused continued operation with consequent injury or damage. The operator does not even have to move or have the trigger pulled out of his hand to stop the machine. The operator need only step back so that no action or reaction time is necessary to avoid injury or damage.

While a preferred embodiment of the invention has been described using specific terms, such description is for illustrative purposes only, and it is to be understood that changes and variations may be made without departing from the spirit or scope of the following claims.

What is claimed is:

1. In a horizontal earth boring machine having an engine, a transmission containing transmission gears, and a boring apparatus including a drill string driven by said engine through said transmission located between said engine and said drill string the improvement comprising:

a hydraulic clutch driven by said engine for driving said transmission;

a solenoid operated valve for supplying hydraulic fluid for operating said clutch; and a manually operated trigger for providing switching to open said valve for supplying hydraulic fluid to said hydraulic clutch so long as said trigger is manually actuated and said engine is running;

whereby a torque resulting from an obstacle such as a rock and transmitted from said drill string through said hydraulic clutch interrupts manual operation of the trigger thereby cutting off switching to said solenoid operated valve and, consequently, disabling operation of the hydraulic clutch releasing momentum of the engine fast enough to avoid injury or damage.

2. The structure set forth in claim 1 including a hydraulic cylinder for advancing said drill string, and an operating handle for controlling said hydraulic cylinder, said trigger being carried by said handle.

3. The structure set forth in claim 2 including a storage tank for hydraulic fluid, and means connecting said storage tank to said hydraulic clutch and to said hydraulic cylinder.

4. A horizontal earth boring machine comprising:

an engine;

a hydraulic pump driven by said engine;

transmission gears;

an earth boring apparatus including a drill string driven by said transmission gears;

a hydraulic clutch coupling said engine and said transmission gears;

a solenoid operated valve providing hydraulic fluid for operating said hydraulic clutch; and a manually operated means maintaining said solenoid operated valve open so long as said manually operated means are operated providing hydraulic fluid to said hydraulic clutch during drilling;

whereby a torque resulting from an obstacle such as a rock and transmitted from said drill string through said hydraulic clutch interrupts manually operated means thereby closing said valve and disabling operation of the hydraulic clutch releasing momentum of the engine fast enough to avoid injury or damage.

5. The structure set forth in claim 4 wherein said manually operated means is a trigger.

6. The structure set forth in claim 5 including a hydraulic means for advancing said boring machine during boring and a manual operational means for controlling said hydraulic means, said trigger being carried adjacent said manual operation means.

7. An earth boring machine having boring apparatus including a drill string comprising:

an engine;

transmission gears for driving said boring apparatus;

a hydraulic clutch coupling said engine and said transmission gears;

hydraulic means advancing said boring apparatus during boring;

a handle controlling said hydraulic means during boring; and a manually operable and automatically returnable trigger actuating said hydraulic clutch so long as said trigger is manually operated;

whereby a torque resulting from an obstacle such as a rock and transmitted from said drill string through said trigger interrupts manually operated means thereby closing said valve and disabling operation of the hydraulic clutch releasing momentum of the engine fast enough to avoid injury or damage.

8. The method of operating a horizontal earth boring machine having a drill string driven by transmission gears driven by an engine comprising the steps of:

coupling the engine to the transmission gears through a hydraulic clutch;

providing a flow of hydraulic fluid to operate said hydraulic clutch and to advance said boring apparatus during drilling; and controlling said flow of hydraulic fluid by a solenoid operated valve controlled by a manually operable means;

whereby a torque resulting from an obstance such as a rock and transmitted from said drill string through said hydraulic clutch interrupts manually operated means thereby closing said valve and disabling operation of the hydraulic clutch releasing momentum of the engine fast enough to avoid injury or damage.

* * * * *